United States Patent [19]

Masuda et al.

[11] Patent Number: 4,498,477

[45] Date of Patent: Feb. 12, 1985

[54] MATTRESS

[75] Inventors: Teruo Masuda; Takeo Abe; Matsuhiro Koike, all of Tokyo, Japan

[73] Assignee: France Bed Co., Ltd., Tokyo, Japan

[21] Appl. No.: 364,205

[22] Filed: Apr. 1, 1982

[30] Foreign Application Priority Data

Jul. 22, 1981 [JP] Japan ..... 56-108690
Jul. 29, 1981 [JP] Japan ..... 56-112464

[51] Int. Cl.[3] ..... A61N 1/40; A47C 27/16

[52] U.S. Cl. ..... 128/378; 5/448; 5/468

[58] Field of Search ..... 128/376–378; 5/446, 447, 448, 461, 468, 469, 481

[56] References Cited

U.S. PATENT DOCUMENTS 2,728,089 12/1955 Hynes ..... 5/447 X
4,047,254 9/1977 Homasu ..... 5/481
4,229,847 10/1980 Degen ..... 5/481
4,407,031 10/1983 Michaels ..... 5/481 X

FOREIGN PATENT DOCUMENTS 879014 1/1980 Belgium ..... 5/462
0018046 10/1980 European Pat. Off. ..... 5/462
2201798 7/1978 Fed. Rep. of Germany ..... 5/468
2930750 2/1981 Fed. Rep. of Germany ..... 5/468
51-116107 9/1976 Japan .
53-18011 5/1978 Japan .
55-34850 8/1980 Japan .

*Primary Examiner*—Lee S. Cohen
*Attorney, Agent, or Firm*—Frishauf, Holtz, Goodman & Woodward

[57] ABSTRACT

A mattress comprises an upper layer having a number of projections formed integrally on the top surface thereof and a lower layer, the upper and lower layers being formed of foamed plastic capable of being deformed by compressive load and restored. A hygroscopic layer formed of a highly hygroscopic material such as cotton is disposed under the upper layer to absorb water from the upper layer. Between the hygroscopic layer and the lower layer lies a middle layer which has a number of columnar core members arranged parallel to and coupled with one another. The core members are formed from relatively hard foamed plastic. An outer covering covers the upper, hygroscopic, middle, and lower layers. Upper and lower spaces are defined between the middle and hygroscopic layers and between the middle and lower layers, respectively, and communicate each other. The water absorbed by the hygroscopic layer is discharged into the upper and lower spaces, where it is discharged into the open air through the outer covering.

13 Claims, 5 Drawing Figures

MATTRESS

BACKGROUND OF THE INVENTION

This invention relates to a mattress.

In general, a mattress comprises a multilayer elastic body formed of a foamed plastic and cotton, and an outer covering in the form of a bag to cover the elastic body. The elastic body gives the mattress elasticity or cushioning effect to support softly a user reposing thereon. There is provided an improved mattress which enables the reposer to enjoy the effect of chiropractic therapy as well as the cushioning effect, and also to maintain a correct recumbent posture to improve his health.

An example of the mattress of this type is disclosed in Japanese Utility Model publication No. 53-18011 (Inventor: M. Hamasu, Publication date: May 15, 1978). According to this prior art mattress, an elastic body including upper, middle and lower layers is covered with an outer covering. The upper and lower layers are formed of elastic foamed plastic such as urethane foam, capable of compressive deformation and restoration. The upper layer has a number of projections about the size of the thumb formed integrally on its top surface. The middle layer is composed of a number of columnar core members made of relatively hard foamed plastic, such as styrene foam, which is only slightly deformed by compressive load. These core members are arranged parallel to one another, each two adjacent ones being coupled tight. In such a mattress, the top surfaces of the coupled core members form a corrugated or rugged surface. Accordingly, a user reposing on the mattress deforms the upper layer by his own weight to receive a rough chiropractic thereapy effect, pressed by the rugged surface of the middle layer. Also, the reposer can enjoy the delicate or fine chiropractic therapy effect produced by the projections on the upper layer. Securely supported by the hard core members, moreover, the reposer can maintain a correct recumbent posture without having the high-density parts of his body, such as the head and buttocks, sunk deep into the mattress. Thus, the reposer or user can improve his health.

However, conventional mattresses of this type including the aforementioned mattress are poor in moisture exhaling property and hence in healthfulness. Although a part of water from perspiration of the reposer evaporates through the upper layer, the other part tends to penetrate the elastic body and to stagnate within the upper layer and between the upper and middle layers, in particular. According to the prior art mattresses, therefore, moisture inside the elastic body cannot efficiently be discharged into the open air, exerting a bad influence to the reposer's health.

Generally, blood in the human body is liable to be acidified. If a person's blood is excessively acidified by drinking or the like, he will possibly suffer from various troubles and ruin his health. In order to neutralize or alkalize the acidified blood, therefore, those who have such acidified blood are conventionally recommended to take alkaline food and drink. Such dietary cure, however, is quite troublesome.

SUMMARY OF THE INVENTION

It is therefore the primary object of this invention to provide a mattress capable of satisfactory disposal of water from perspiration.

It is another object of this invention to provide a mattress capable of alkalizing the blood of a user reposing thereon.

In order to attain the primary object, according to one embodiment of this invention, a hygroscopic layer formed of a hygroscopic material is disposed under an upper layer. A middle layer having a number of columnar core members formed of relatively hard foamed plastic and arranged parallel to and coupled with one another is interposed between the hygroscopic layer and a lower layer. Upper and lower spaces are defined between the middle layer and the hygroscopic layer and between the middle layer and the lower layer, respectively, communicating with each other. In such construction, that part of water from perspiration of a user or reposer which is absorbed by the upper layer is absorbed by the hygroscopic layer, and discharged into the upper and lower spaces. Here it is to be understood that the upper and lower spaces face the open air with an outer covering therebetween. Thus, air or moisture containing the discharged water may efficiently be discharged into the open air through the outer covering.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENT

Figure 1:
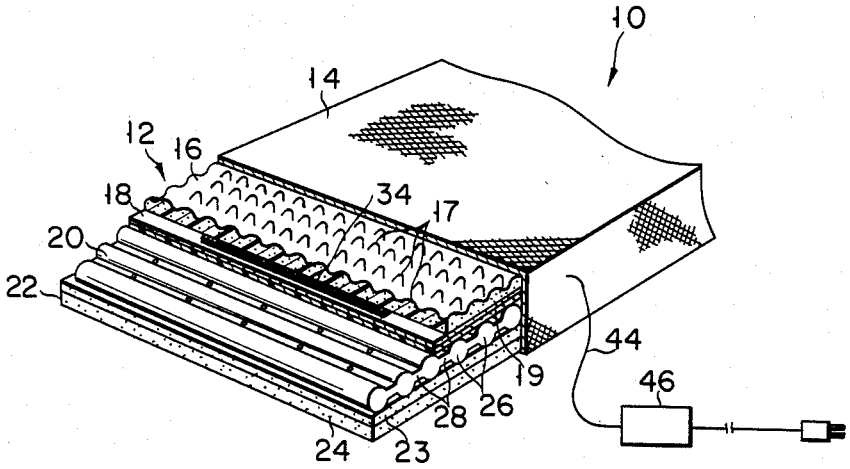
FIG. 1 is a partially broken perspective view of a mattress according to a preferred embodiment of this invention.
Figure 2:
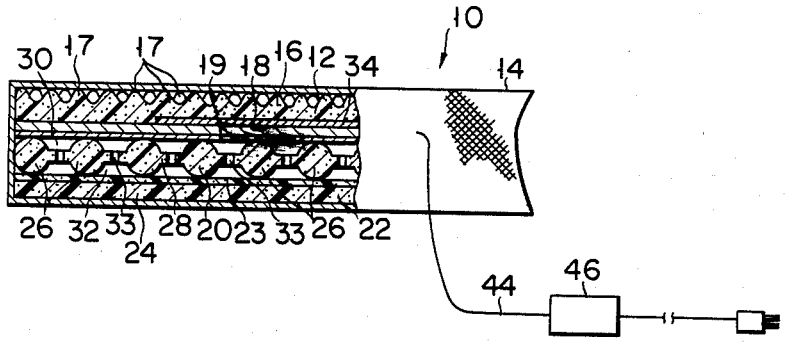
FIG. 2 is a longitudinal sectional view of the mattress shown in FIG. 1.

As seen from FIGS. 1 and 2, a mattress 10 according to this invention comprises a four-layer elastic body 12 and an outer covering 14 which covers the elastic body 12. The outer covering 14 is in the form of a bag with an open end which is sewn up after the elastic body 12 is inserted therethrough into the outer covering.

The elastic body 12 has a four-layer structure including an upper layer 16, a hygroscopic layer 18, a middle layer 20, and a lower layer 22 arranged downward in the order named. Both the upper and lower layers 16 and 22 are formed of foamed plastic such as urethane foam to such hardness that the layers can fully be deformed by compressive load and restored. The lower layer 22 is comprised of two sheets; an upper sheet 23 and a lower sheet 24 softer and thicker than the upper sheet. A number of projections 17 are formed integrally on the top surface of the upper layer 16 so that the top surface is rugged. Each of the projections 17 has the size of e.g. a thumb which can produce a delicate chiropractic therapy effect.

The middle layer 20 is provided with a number of columnar core members 26 formed of relatively hard foamed plastic such as polyethylene foam. The core members 26 are harder than the upper and lower layers 16 and 22, and can be slightly elastically deformed by compressive load. The core members 26 are arranged parallel to one another and formed integrally with coupling portions 28 between them.

The hygroscopic layer 18 is formed of a highly hygroscopic material such as cotton into a layer, and an unwoven fabric 19 for maintaining the shape of the hygroscopic layer 18 is bonded to the lower surface of the hygroscopic layer 18. It is known that a highly hygroscopic material such as cotton is generally high in moisture exhaling property.

Since the middle layer 20 interposed between the hygroscopic layer 18 and the lower layer 22 is formed of the columnar core members 26 arranged parallel to one another, an upper space 30 (see FIG. 2) is defined between the hygroscopic layer 18 and the middle layer 20 and a lower space 32 is defined between the middle layer 20 and the upper sheet 23 of the lower layer 22. The upper and lower spaces 30 and 32 communicate by means of a number of communication passages 33 formed in the coupling portions 28. The communication passages 33 need only have a function to connect the spaces 30 and 32, and are optional in shape, arrangement and number.

Figure 3:
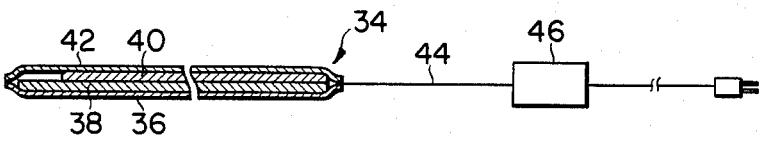
FIG. 3 is a partial longitudinal sectional view of an electrode sheet.
Figure 4:
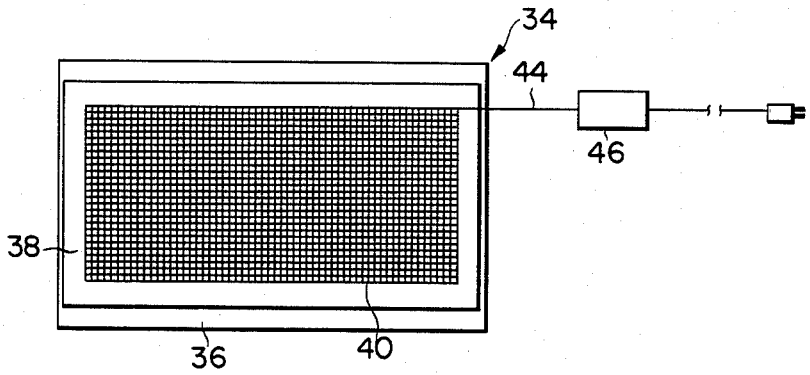
FIG. 4 is a top plan view of the electrode sheet with an upper sheet removed.

Further, an electrode sheet 34 is sandwiched between the upper layer 16 and the hygroscopic layer 18. The electrode sheet 34, as seen from FIGS. 3 and 4, includes a lower sheet 36 formed of transparent plastic, a piece of cloth 38 stuck on the lower sheet 36, netted electrode sheet 40 stuck on the cloth 38, and an upper sheet 42 formed of transparent plastic and stuck on the electrode sheet 40. Hereupon, the end portions of the upper and lower sheets 42 and 36 are bonded together so as to hold the cloth 38 and the electrode sheet 40 between them. An electric wire 44 is connected with the electrode sheet 40, and a negative potential generator 46 is connected to the wire 44. When the negative potential generator 46 is supplied with electricity, a negative voltage of −300 V or thereabouts is produced in the electrode sheet 40. If a negative voltage is applied to a human body, sodium and calcium ions in blood in the human body increase to alkalize the blood.

When a user reposes on the mattress 10 of this invention of the above-mentioned construction, he can enjoy the delicate chiropractic therapy effect produced by the projections 17 on the top surface of the upper layer 16, as well as the soft touch of the upper layer felt through the outer covering 14. Even if the upper layer 16 and the hygroscopic layer 18 are fully deformed by the compressive load from the user's weight, the middle layer 20, harder than those two layers, will be deformed only slightly, so that the user will be able to be sustained in a correct recumbent posture with his back straight and without having his high-density parts, such as the head and buttocks, sunk deep into the mattress. Besides, the reposing user can enjoy a rough chiropractic therapy effect through the rugged surface formed by the core members 26 of the middle layer 20. Thus, the user can simultaneously enjoy the effects of both delicate and rough chiropractic therapy while maintaining the correct recumbent posture, so that he can improve his health as he reposes on the mattress.

As mentioned above, the upper sheet 23 of the lower layer 22 is softer than the middle layer 20 on which the weight of the reposer is concentratedly exerted. Thus the upper sheet 23 works as a cushion for the middle layer 20. Since the lower sheet 24 of the lower layer 22 is softer than the upper sheet 23, it works as a cushion for the upper sheet 23. The mattress 10 therefore has a great cushioning effect, and the reposer may thus lie on the mattress, feeling comfortable.

Meanwhile, part of water from perspiration of the reposer evaporates without penetrating the upper layer 16, while the remaining part of the water permeates the upper layer. Since the highly hygroscopic layer 18 underlies the upper layer 16, however, the water in the upper layer will be absorbed by the hygroscopic layer without remaining in the upper layer. Thus, the upper layer 16 can be kept dry. Further, the hygroscopic layer 18 is high in moisture exhaling property as well as in hygroscopic property, so that the water absorbed by the hygroscopic layer is discharged therefrom into the upper spaces 30. The water discharged into the upper spaces 30 is absorbed by the air to turn into moisture, which flows from the upper spaces 30 into the lower spaces 32 through the communication passages 33. Containing the water from the reposer, the air inside the spaces 30 and 32 is higher in temperature than the open air. Accordingly, the air inside the spaces 30 and 32 and the open air are convected through the outer covering 14, and the moisture inside the spaces 30 and 32 flows along the axial direction of the core members 26 to be discharged into the open air. Then, the water absorbed by the hygroscopic layer 18 is also discharged into the open air, and the hygroscopic layer can be kept dry, too. Thus, there may be provided a healthful mattress in which the upper layer 16 and the hygroscopic layer 18 can be kept dry without holding water.

If the negative potential generator 46 is actuated, moreover, a negative voltage of approximately −300 V is produced in the electrode sheet 34 to alkalize the blood of the reposer. Accordingly, the user can make his blood alkaline to improve his health by only reposing on the mattress without such trouble as is involved in a dietary cure.

The efficiency of alkalization can be increased by bringing the electrode sheet 34 closer to the user's body. Since the electrode sheet 34, however, is harder than the upper sheet 16, the cushioning effect of the mattress 10 will be reduced if the electrode sheet is disposed over the upper layer 16. It is therefore advisable to locate the electrode sheet 34 at the uppermost portion of the elastic body 12 to maintain the cushioning effect thereof, usually between the upper layer 16 and the hygroscopic layer 18. In consideration of the cushioning effect of the mattress 10, moreover, the electrode sheet 34 should preferably be minimized in size, and be partially located under a position in which the buttocks of the reposer is supposed to be located. With the electrode sheet 34 located in such a position, the upper layer 16 may be deformed so much by the high-density buttocks that the reposer's body can be brought close to the electrode sheet 34, and the negative voltage can securely be applied to the reposer's body due to limited dislocation of the buttocks.

Since the core members 26 of the middle layer 20 are formed integrally with the coupling portions 28 between them, the middle layer can be easily manufactured at low cost. Owing to the integral forming of the core members 26, moreover, the core members are prevented from moving across their axes, so that the reposer will never feel uncomfortable.

Figure 5:
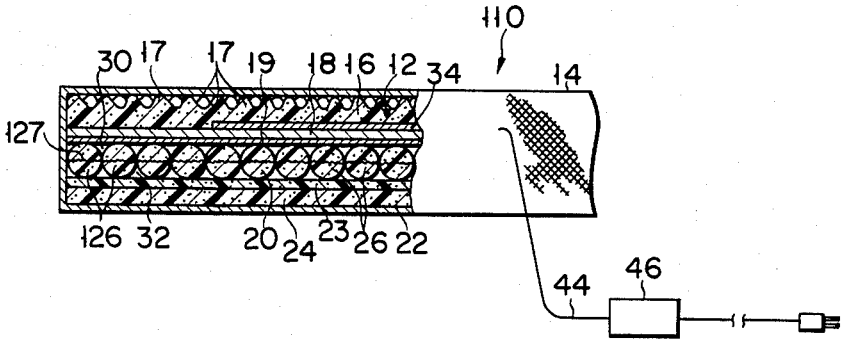
FIG. 5 is a longitudinal sectional view of a mattress according to another preferred embodiment of this invention.

FIG. 5 shows a mattress 110 according to another embodiment of this invention. The mattress 110 differs from the above-mentioned mattress 10 only in that core members 126 forming a middle layer 120 are coupled by means of cords 127. In such construction, the upper and lower spaces 30 and 32 can fully communicate with each other without any communication passages between them. As a result, moisture can smoothly flow from the upper spaces 30 to the lower spaces 32. Further, the core members 126 can slightly move across their axes. Although possibly giving the reposer a sense of instability, such movement of the core members 126 will produce a massage effect to take off the stiffness of muscles of the reposer, taking advantage of the smooth, curved surfaces of the columnar core members 126.

What we claim is:

1. A mattress comprising:

an upper layer formed of foamed plastic capable of being deformed by compressive load and restored, and said upper layer having a number of projections formed integrally on the top surface thereof;

a lower layer formed plastic capable of being deformed by compressive load and restored;

a hygroscopic layer formed of a highly hygroscopic material and underlying the upper layer;

a middle layer having a number of columnar core members formed of relatively hard foamed plastic and interposed between the hygroscopic layer and the lower layer, the core members of the middle layer being arranged parallel to and spaced from each other and formed integrally with coupling portions therebetween so as to define upper elongated spaces between adjacent core members and between the middle and hygroscopic layers and lower elongated spaces between adjacent core members and between the middle and lower layers, said coupling portions having communication passages formed therein through which the upper and lower spaces are in air communication with each other;

and an air permeable outer covering which covers the upper, hygroscopic, middle, and lower layers;

said upper and lower elongated spaces extending to said outer covering so as to be in air communication with said outer covering, whereby moist air in said upper and lower spaces permeates to the outside through said outer covering.

2. A mattress according to claim 1, further comprising a source of negative potential and an electrode sheet interposed between the upper and hygroscopic layers and connected to said source of negative potential.

3. A mattress according to claim 2, wherein said electrode sheet is partially disposed at a predetermined position of the mattress at which the buttocks of a lying user is adapted to be located.

4. A mattress according to claim 1, wherein said projections formed integrally on the top surface of said upper layer are approximately thumb-size.

5. A mattress according to claim 1, wherein said communication passages in said coupling portions comprise openings in said coupling portions which extend between said upper and lower spaces.

6. A mattress according to claim 1, wherein said upper and lower spaces extend in the axial direction of said columnar core members.

7. A mattress according to claim 1, wherein said core members are harder than the upper and lower layers.

8. A mattress according to claim 7, wherein said core members are slightly elastically deformable under a compressive load applied thereto.

9. A mattress according to claim 1, wherein said hyproscopic layer comprises a layer of cotton and a layer of unwoven fabric bonded to a lower surface of said cotton layer.

10. A mattress according to claim 1, wherein said lower layer comprises first and second sheet-like layers, said first sheet-like layer being arranged above said second sheet-like layer, and said second sheet-like layer being softer and thicker than said first sheet-like layer.

11. A mattress according to claim 1, wherein:

said core members are harder than said upper and lower layers;

said hygroscopic layer comprises a cotton layer and an unwoven fabric layer bonded to a lower surface of said cotton layer; and said lower layer comprises first and second sheet-like layers, said first sheet-like layer being arranged above said second sheet-like layer, and said second sheet-like layer being softer and thicker than said first sheet-like layer.

12. A mattress according to claim 11, wherein said projections integrally formed on the top surface of said upper layer are approximately thumb-sized.

13. The mattress according to claim 12, wherein said core members are only slightly elastically deformable by a compressive load applied thereto.

* * * * *